US008794356B2

(12) United States Patent
Lyons et al.

(10) Patent No.: US 8,794,356 B2
(45) **Date of Patent: *Aug. 5, 2014**

(54) SHAPED CUTTING ELEMENTS ON DRILL BITS AND OTHER EARTH-BORING TOOLS, AND METHODS OF FORMING SAME

(75) Inventors: Nicholas J. Lyons, Houston, TX (US); Rudolf Carl Pessier, Spring, TX (US); Danny E. Scott, Montgomery, TX (US); David Gavia, The Woodlands, TX (US); Juan Miguel Bilen, The Woodlands, TX (US); Anthony A. DiGiovanni, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 173 days.

This patent is subject to a terminal disclaimer.

(21) Appl. No.: 13/022,288

(22) Filed: Feb. 7, 2011
(Under 37 CFR 1.47)

(65) Prior Publication Data

US 2011/0192651 A1 Aug. 11, 2011

Related U.S. Application Data

(60) Provisional application No. 61/301,946, filed on Feb. 5, 2010.

(51) Int. Cl.
*E21B 10/36* (2006.01)

(52) U.S. Cl.
USPC ..... 175/431; 175/331; 175/428; 76/108.4

(58) Field of Classification Search
CPC . E21B 10/5673; E21B 10/5735; E21B 10/55; E21B 10/5676; C22C 26/00
USPC ..... 175/430, 431, 432, 428, 420.2, 331, 175/391, 57; 76/108.4
See application file for complete search history.

(56) References Cited

U.S. PATENT DOCUMENTS 3,459,073 A 8/1969 Conover
4,373,593 A 2/1983 Phaal et al.

(Continued)

FOREIGN PATENT DOCUMENTS

EP 972908 A2 1/2000
GB 2086451 5/1982

OTHER PUBLICATIONS

International Search Report for International Application No. PCT/US2011/023922 mailed Sep. 7, 2011, 3 pages.

(Continued)

*Primary Examiner* — Yong-suk (Philip) Ro
(74) *Attorney, Agent, or Firm* — TraskBritt

(57) ABSTRACT

Earth-boring tools include a body, one or more blades projecting outwardly from the body, and cutting elements carried by the blade. The cutting elements include at least one shearing cutting element and at least one gouging cutting element. Methods of forming an earth-boring tool include mounting a shearing cutting element comprising an at least substantially planar cutting face to a body of an earth-boring tool, and mounting a gouging cutting element comprising a non-planar cutting face to the body of the earth-boring tool. The gouging cutting element may be positioned on the body of the earth-boring tool such that the gouging cutting element will gouge formation material within a kerf cut in the formation material by the shearing cutting element, or between kerfs cut in the formation material by a plurality of shearing cutting elements.

26 Claims, 7 Drawing Sheets

(56) References Cited

U.S. PATENT DOCUMENTS

| | | | | |
|---|---|---|---|---|
| 4,440,247 | A | 4/1984 | Sartor | |
| 4,471,845 | A | 9/1984 | Jurgens | |
| 4,499,958 | A | 2/1985 | Radtke et al. | |
| 4,602,691 | A | 7/1986 | Weaver | |
| 4,718,505 | A | 1/1988 | Fuller | |
| 4,722,405 | A | 2/1988 | Langford, Jr. | |
| 4,823,892 | A | 4/1989 | Fuller | |
| 4,869,330 | A | 9/1989 | Tibbitts | |
| 4,889,017 | A | 12/1989 | Fuller et al. | |
| 4,942,933 | A | 7/1990 | Barr et al. | |
| 4,981,184 | A | 1/1991 | Knowlton et al. | |
| RE33,757 | E | 12/1991 | Weaver | |
| 5,186,268 | A | 2/1993 | Clegg | |
| 5,244,039 | A | 9/1993 | Newton, Jr. et al. | |
| 5,303,785 | A | 4/1994 | Duke | |
| 5,487,436 | A | 1/1996 | Griffin | |
| 5,505,273 | A | 4/1996 | Azar et al. | |
| 5,531,281 | A | 7/1996 | Murdock | |
| 5,549,171 | A | 8/1996 | Mensa-Wilmot et al. | |
| 5,558,170 | A | 9/1996 | Thigpen et al. | |
| 5,595,252 | A | 1/1997 | O'Hanlon | |
| 5,607,024 | A | 3/1997 | Keith et al. | |
| 5,649,604 | A | 7/1997 | Fuller et al. | |
| 5,720,357 | A | 2/1998 | Fuller et al. | |
| 5,890,552 | A | 4/1999 | Scott et al. | |
| 5,904,213 | A | 5/1999 | Caraway et al. | |
| 5,957,227 | A | 9/1999 | Besson et al. | |
| 5,967,246 | A | 10/1999 | Caraway et al. | |
| 5,992,547 | A | 11/1999 | Caraway et al. | |
| 6,053,263 | A | 4/2000 | Meiners | |
| 6,059,054 | A | 5/2000 | Portwood et al. | |
| 6,089,336 | A | 7/2000 | Nexton et al. | |
| 6,092,613 | A | 7/2000 | Caraway et al. | |
| 6,129,161 | A | 10/2000 | Roberts et al. | |
| 6,142,250 | A | 11/2000 | Griffin et al. | |
| 6,209,420 | B1 | 4/2001 | Butcher et al. | |
| 6,328,117 | B1 | 12/2001 | Berzas et al. | |
| 6,332,503 | B1 | 12/2001 | Pessier et al. | |
| 6,401,844 | B1 | 6/2002 | Doster et al. | |
| 6,408,958 | B1 | 6/2002 | Isbell et al. | |
| 6,612,383 | B2 | 9/2003 | Desai et al. | |
| 6,615,934 | B2 | 9/2003 | Mensa-Wilmot | |
| 7,025,156 | B1 | 4/2006 | Caraway | |
| 7,216,565 | B2 | 5/2007 | Sherwood, Jr. et al. | |
| 7,546,888 | B2 | 6/2009 | Cruz | |
| 7,594,554 | B2 | 9/2009 | Schwefe et al. | |
| 7,628,233 | B1 | 12/2009 | Hall et al. | |
| 7,641,002 | B2 | 1/2010 | Hall et al. | |
| 2003/0034180 | A1 | 2/2003 | Mensa-Wilmot | |
| 2004/0149493 | A1* | 8/2004 | McDonough | 175/331 |
| 2004/0184944 | A1 | 9/2004 | Geving et al. | |
| 2004/0231894 | A1 | 11/2004 | Dvorachek | |
| 2006/0131075 | A1* | 6/2006 | Cruz | 175/57 |
| 2006/0249309 | A1 | 11/2006 | Cruz | |
| 2007/0039761 | A1 | 2/2007 | Cruz | |
| 2007/0106487 | A1 | 5/2007 | Gavia et al. | |
| 2007/0199739 | A1 | 8/2007 | Schwefe et al. | |
| 2007/0261890 | A1 | 11/2007 | Cisneros | |
| 2007/0272445 | A1 | 11/2007 | Cariveau et al. | |
| 2008/0029312 | A1 | 2/2008 | Hall et al. | |
| 2008/0035380 | A1 | 2/2008 | Hall et al. | |
| 2008/0035387 | A1 | 2/2008 | Hall et al. | |
| 2008/0173482 | A1 | 7/2008 | Hall et al. | |
| 2008/0179106 | A1 | 7/2008 | Gavia et al. | |
| 2008/0179107 | A1 | 7/2008 | Doster | |
| 2008/0179108 | A1 | 7/2008 | McClain et al. | |
| 2008/0223622 | A1* | 9/2008 | Duggan et al. | 175/432 |
| 2008/0264695 | A1 | 10/2008 | Zahradnik et al. | |
| 2008/0302575 | A1 | 12/2008 | Durairajan et al. | |
| 2008/0314647 | A1 | 12/2008 | Hall et al. | |
| 2009/0051211 | A1 | 2/2009 | Hall et al. | |
| 2009/0055135 | A1 | 2/2009 | Tang et al. | |
| 2009/0126998 | A1 | 5/2009 | Zahradnik et al. | |
| 2009/0133938 | A1 | 5/2009 | Hall et al. | |
| 2009/0145669 | A1 | 6/2009 | Durairajan et al. | |
| 2009/0266619 | A1 | 10/2009 | Durairajan et al. | |
| 2009/0273224 | A1 | 11/2009 | Hall | |
| 2010/0155149 | A1 | 6/2010 | Keshavan et al. | |
| 2010/0263939 | A1 | 10/2010 | Hall et al. | |
| 2010/0326740 | A1 | 12/2010 | Hall et al. | |
| 2011/0042150 | A1 | 2/2011 | Hall et al. | |
| 2011/0083906 | A1 | 4/2011 | Hall et al. | |
| 2011/0155472 | A1 | 6/2011 | Lyons et al. | |
| 2012/0023833 | A1 | 2/2012 | Hall et al. | |
| 2012/0031674 | A1 | 2/2012 | Lyons | |
| 2012/0125687 | A1 | 5/2012 | Rives | |

OTHER PUBLICATIONS

International Written Opinion for International Application No. PCT/US2011/023922 mailed Sep. 7, 2011, 3 pages.

Lyons et al., U.S. Appl. No. 12/793,396 entitled, Earth-Boring Tools Having Differing Cutting Elements on a Blade and Related Methods, filed Jun. 3, 2010.

Gavia et al., U.S. Appl. No. 13/101,840 entitled, Earth-Boring Tools and Methods of Forming Such Earth-Boring Tools, filed May 5, 2011.

Gavia et al., U.S. Appl. No. 13/101,840 entitled, Earth-Boring Tools and Methods of Forming Such Earth-Boring Tools filed May 5, 2011.

International Preliminary Report on Patentability for International Application No. PCT/US2011/023922 dated Aug. 7, 2012, 4 pages.

Bilen et al., U.S. Appl. No. 61/596,433 entitled, Shaped Cutting Elements for Earth-Boring Tools, Earth-Boring Tools Including Such Cutting Elements, and Related Methods, filed Feb. 8, 2012.

* cited by examiner

SHAPED CUTTING ELEMENTS ON DRILL BITS AND OTHER EARTH-BORING TOOLS, AND METHODS OF FORMING SAME

CROSS-REFERENCE TO RELATED APPLICATION

This application claims the benefit of U.S. Provisional Patent Application Ser. No. 61/301,946, filed Feb. 5, 2010, entitled "Shaped Backup Cutting Elements on Drill Bits and Other Earth-Boring Tools, and Methods of Forming Same," the disclosure of which is incorporated herein by reference in its entirety.

FIELD

Embodiments of the present disclosure relate to earth-boring tools, such as earth-boring rotary drill bits, and, more particularly, to earth-boring rotary tools having cutting elements attached to an outer surface of a body thereof.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit such as, for example, an earth-boring rotary drill bit. Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end and extends into the wellbore from the surface of the formation. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

It is known in the art to use what are referred to in the art as a "reamer" devices (also referred to in the art as "hole-opening devices" or "hole openers") in conjunction with a drill bit as part of a bottom hole assembly when drilling a wellbore in a subterranean formation. In such a configuration, the drill bit operates as a "pilot" bit to form a pilot bore in the subterranean formation. As the drill bit and bottom hole assembly advances into the formation, the reamer device follows the drill bit through the pilot bore and enlarges the diameter of, or "reams," the pilot bore.

The bodies of earth-boring tools, such as drill bits and reamers, are often provided with fluid courses, such as "junk slots," to allow drilling mud (which may include drilling fluid and formation cuttings generated by the tools that are entrained within the fluid) to pass upwardly around the bodies of the tools into the annular shaped space within the wellbore above the tools outside the drill string.

BRIEF SUMMARY

In some embodiments, the present disclosure includes earth-boring tools. The tools include a body, at least one blade projecting outwardly from the body, and a plurality of cutting elements carried by the at least one blade. The cutting elements include at least one shearing cutting element and at least one gouging cutting element located rotationally behind the at least one shearing cutting element on the at least one blade. The at least one shearing cutting element comprises an at least substantially planar cutting face positioned and oriented for shearing a subterranean formation when the earth-boring tool is rotated under applied force to form or enlarge a wellbore. The at least one gouging cutting element comprises a cutting face positioned and oriented for at least one of crushing and gouging a subterranean formation when the earth-boring tool is rotated under applied force to form or enlarge a wellbore.

In additional embodiments, the present disclosure includes methods of forming an earth-boring tool. A shearing cutting element comprising an at least substantially planar cutting face may be mounted to a body of an earth-boring tool. The shearing cutting element may be located and oriented on the body of the earth-boring tool for shearing a subterranean formation when the earth-boring tool is used to form or enlarge a wellbore. A backup gouging cutting element comprising a non-planar cutting face may be mounted to the body of the earth-boring tool. The backup gouging cutting element may be located and oriented on the body of the earth-boring tool for at least one of crushing and gouging a subterranean formation when the earth-boring tool is used to form or enlarge a wellbore. The backup gouging cutting element may be positioned on the body of the earth-boring tool such that the backup gouging cutting element will gouge formation material substantially within a kerf cut in the formation material by the shearing cutting element.

In some embodiments, the disclosure includes a method of forming an earth-boring tool, comprising mounting a plurality of shearing cutting elements, each comprising an at least substantially planar cutting face to a body of an earth-boring tool. The method may comprise locating and orienting each shearing cutting element of the plurality on the body of the earth-boring tool for shearing a subterranean formation when the earth-boring tool is used to form or enlarge a wellbore. The method may comprise mounting a gouging cutting element comprising a non-planar cutting face to the body of the earth-boring tool. The method may also comprise positioning the gouging cutting element on the body of the earth-boring tool such that the gouging cutting element will gouge formation material between kerfs cut in the formation material by the plurality of shearing cutting elements.

BRIEF DESCRIPTION OF THE DRAWINGS

While the specification concludes with claims particularly pointing out and distinctly claiming what are regarded as embodiments of the present disclosure, various features and advantages of this disclosure may be more readily ascertained from the following description of example embodiments of the disclosure provided with reference to the accompanying drawings, in which:

DETAILED DESCRIPTION

The illustrations presented herein are not actual views of any particular earth-boring tool, drill bit, or component of such a tool or bit, but are merely idealized representations that are employed to describe embodiments of the present disclosure.

As used herein, the term earth-boring tool means and includes any tool used to remove formation material and form a bore (e.g., a wellbore) through the formation by way of the removal of a portion of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, casing mills and drill bits, exit tools, reamers (including expandable reamers and fixed-wing reamers), and other so-called "hole-opening" tools.

As used herein, the term "cutting element" means and includes any element of an earth-boring tool that is used to cut or otherwise disintegrate formation material when the earth-boring tool is used to form or enlarge a bore in the formation.

As used herein, the term "shearing cutting element" means and includes any cutting element of an earth-boring tool that has an at least substantially planar cutting face that is configured to be located and oriented on the earth-boring tool for cutting formation material at least primarily by a shearing mechanism when the earth-boring tool is used to form or enlarge a bore in the formation.

As used herein, the term "gouging cutting element" means and includes any cutting element of an earth-boring tool that has a non-planar cutting face that is configured to be located and oriented on the earth-boring tool for cutting formation material at least primarily by at least one of a gouging and a crushing mechanism when the earth-boring tool is used to form or enlarge a bore in the formation.

As used herein, the term "backup cutting element" means and includes any cutting element of an earth-boring tool that is positioned and configured to rotationally follow another cutting element of the tool, such that the backup cutting element will engage formation material within a kerf previously cut in the formation material by the shearing cutting element. A backup cutting element and a corresponding primary cutting element (i.e., the cutting element that is "backed up" by the backup cutting element) may both be positioned an equal distance from a longitudinal axis of the earth-boring tool to which they are mounted (i.e., at the same radial position).

As used herein, the term "backup gouging cutting element" means a cutting element that is both a gouging cutting element and a backup cutting element.

Figure 1:
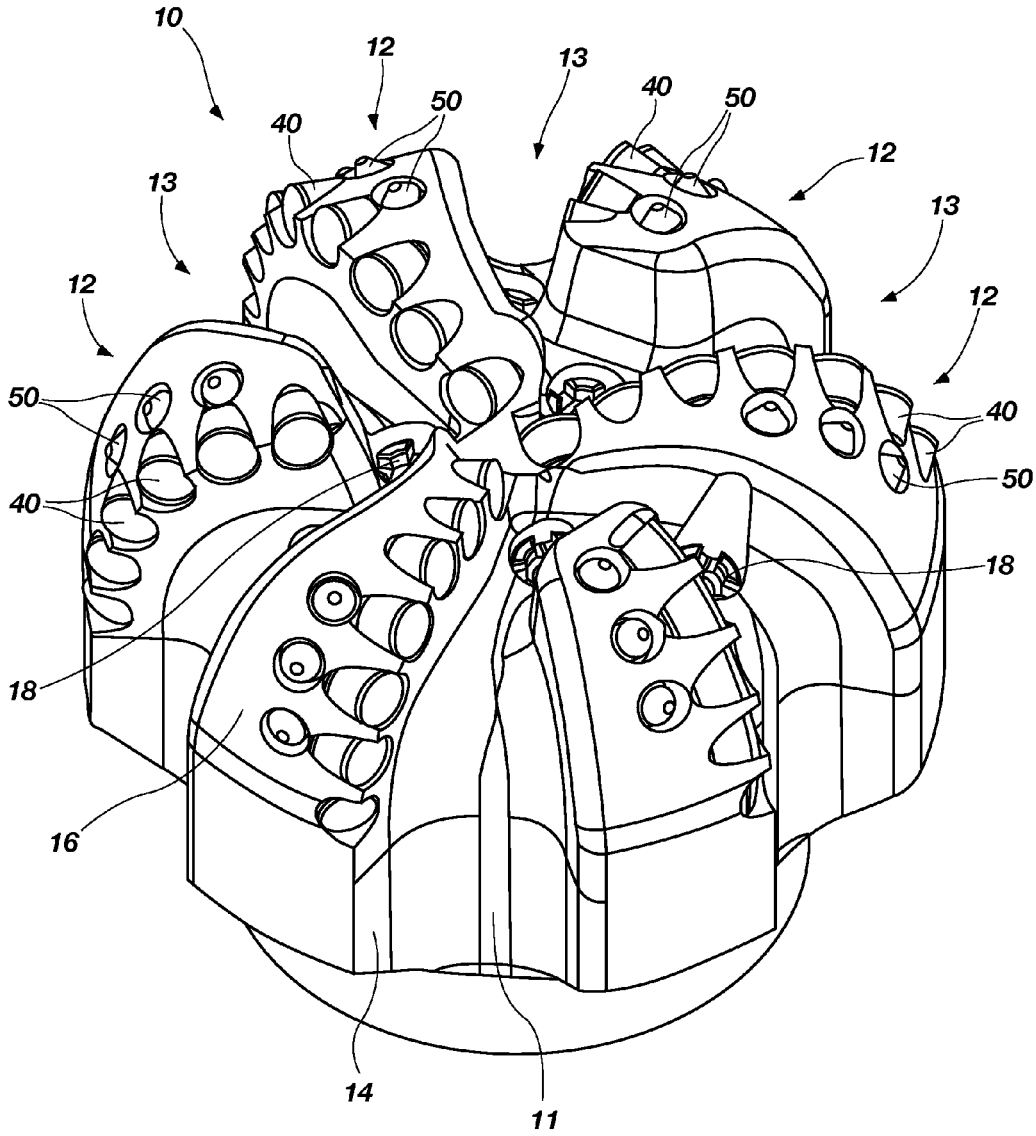
FIG. 1 is a perspective view of an embodiment of an earth-boring tool of the present invention comprising a rotary fixed-cutter drill bit that includes shearing cutting elements and gouging cutting elements on blades thereof.

FIG. 1 illustrates an embodiment of an earth-boring tool of the present disclosure. The earth-boring tool of FIG. 1 is a fixed-cutter rotary drill bit 10 having a bit body 11 that includes a plurality of blades 12 that project outwardly from the bit body 11 and are separated from one another by fluid courses 13. The portions of the fluid courses 13 that extend along the radial sides (the "gage" areas of the drill bit 10) are often referred to in the art as "junk slots." The bit body 11 further includes a generally cylindrical internal fluid plenum and fluid passageways that extend through the bit body 11 to the exterior surface of the bit body 11. Nozzles 18 may be secured within the fluid passageways proximate the exterior surface of the bit body 11 for controlling the hydraulics of the drill bit 10 during drilling. A plurality of cutting elements is mounted to each of the blades 12. The plurality of cutting elements includes shearing cutting elements 40 and gouging cutting elements 50. The shearing cutting elements 40 may be mounted along a rotationally leading surface 14 of the blade 12, such as along an intersection of the rotationally leading surface 14 with an exterior surface 16 of the blade 12. The gouging cutting elements 50 may be mounted along the exterior surface 16 of the blade 12. The gouging cutting elements 50 may be mounted to the blades 12 rotationally behind the shearing cutting elements 40 on the blades 12. The gouging cutting elements 50 may be redundant with the shearing cutting elements 40. In other words, a gouging cutting element 50 may be a backup gouging cutting element, located at the same longitudinal and radial position in the cutting element profile as a corresponding shearing cutting element 40, such that the backup gouging cutting element will at least substantially follow a path of a corresponding shearing cutting element 40 (i.e., will gouge formation material substantially within a kerf cut in the formation material by shearing cutting element 40). Each redundant pair including a shearing cutting element 40 and a backup gouging cutting element may be located on a common blade 12, or on different blades 12 of the drill bit 10. In embodiments in which a shearing cutting element 40 and a backup gouging cutting element of a redundant pair are located on different blades 12 of the drill bit 10, the backup gouging cutting element may still directly follow the shearing cutting element 40 within the kerf cut in the formation by the shearing cutting element 40. In some embodiments, gouging cutting elements 50 may be radially offset from shearing cutting elements 40 (i.e., gouging cutting elements 50 may not follow paths formed by shearing cutting elements 40, but instead follow their own unique paths).

During a drilling operation, the drill bit 10 may be coupled to a drill string (not shown). As the drill bit 10 is rotated within the wellbore, drilling fluid may be pumped down the drill string, through the internal fluid plenum and fluid passageways within the bit body 11 of the drill bit 10, and out from the drill bit 10 through the nozzles 18. Formation cuttings generated by the cutting elements 40, 50 of the drill bit 10 may be carried with the drilling fluid through the fluid courses 13, around the drill bit 10, and back up the wellbore through the annular space within the wellbore outside the drill string.

Figure 2A:
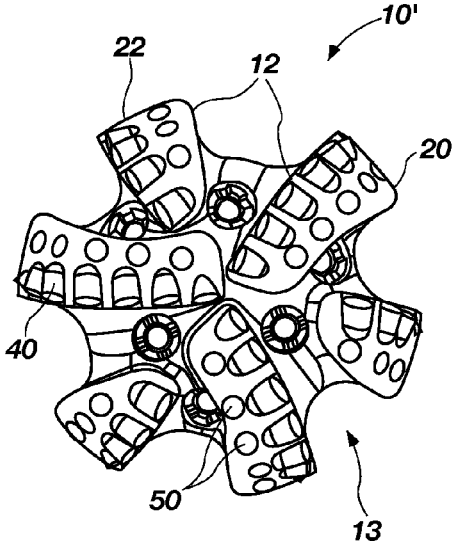
FIGS. 2A through 2C are views of the another earth-boring tool of the present invention.

FIG. 2A is another embodiment of a drill bit 10' according to the disclosure. The blades 12 of the drill bit 10' may be primary blades 20 or secondary blades 22. Primary blades 20 are those blades 12 that that extend over the face of the bit body 11 proximate to the center rotational axis of the drill bit 10'. Secondary blades 22 do not extend proximate to the center rotational axis of the drill bit 10'. The drill bits 10, 10' shown in FIGS. 1 and 2A each have three primary blades 20 and three secondary blades 22. A person having ordinary skill in the art will recognize that drill bits may have any number of primary blades 20 and secondary blades 22, and that the number of primary blades 20 need not equal the number of secondary blades 22. Shearing cutting elements 40 and gouging cutting elements 50 may be disposed on primary blades 20 and/or on secondary blades 22. In some embodiments, gouging cutting elements 50 are disposed only on primary blades 20, whereas shearing cutting elements 40 are disposed on both primary blades 20 and secondary blades 22.

Figure 2B:
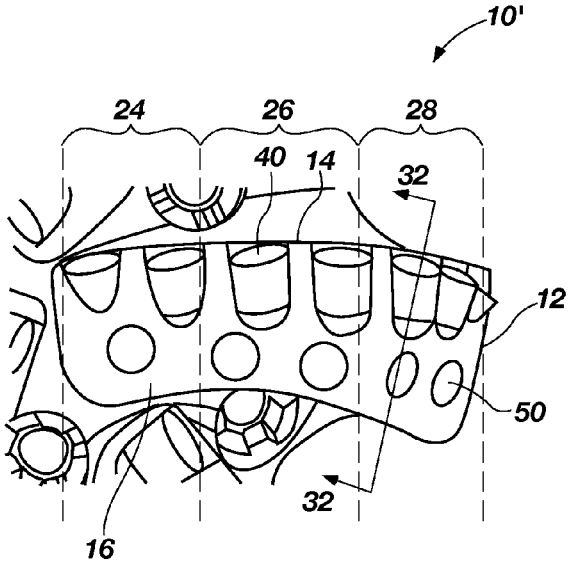

FIG. 2B is another view of a portion of the drill bit 10' shown in FIG. 2A. Regions of the blades 12 may be referred to herein and in the art as a cone region 24, a nose region 26, and a shoulder region 28. Shearing cutting elements 40 and/or gouging cutting elements 50 may be disposed within the cone region 24, the nose region 26, and/or the shoulder region 28. Primary blades 20 may include all three regions (cone region 24, nose region 26, and shoulder region 28). Secondary blades 22 may include only nose regions 26 and shoulder regions 28.

Figure 2C:
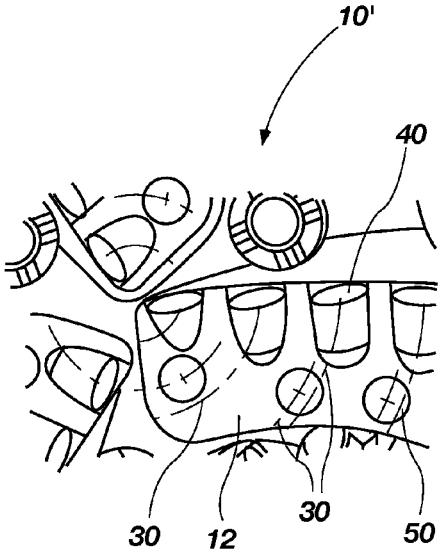

FIG. 2C is a view of a portion of the drill bit 10' shown in FIGS. 2A and 2B, indicating paths 30 of shearing cutting elements 40 and gouging cutting elements 50. The paths 30 form circular or helical arcs as the drill bit 10' rotates. Each gouging cutting element 50 may follow a path 30 of a shearing cutting element 40, or may follow its own unique path 30. In other words, the path 30 of a gouging cutting element 50 may be offset from or between paths 30 of shearing cutting elements 40. In embodiments in which gouging cutting elements 50 follow paths 30 of shearing cutting elements 40 (i.e., embodiments in which some gouging cutting elements 50 are backup gouging cutting elements), gouging cutting elements 50 may follow paths 30 of shearing cutting elements 40 disposed on the same blade 12 or on different blades 12.

Figure 2D:
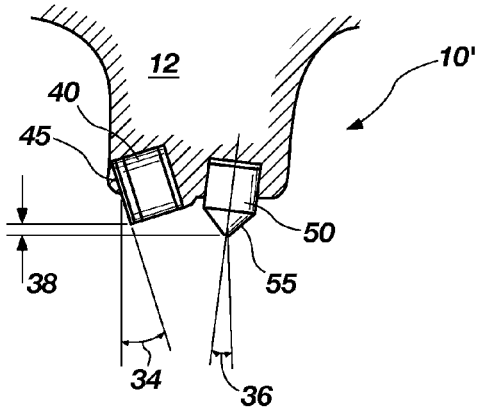
FIG. 2D is a cross-sectional view of a blade of the tool shown in FIGS. 2A through 2C, taken along section line 32-32 in FIG. 2B.

FIG. 2D is a cross-sectional view of a portion of the drill bit 10' taken along line 32-32 in FIG. 2B. Shearing cutting elements 40 may be mounted with a positive back rake angle 34, as shown in FIG. 2D, with a neutral back rake angle, or with a negative back rake angle (i.e., a forward rake angle) of their respective cutting faces 45. The shearing cutting elements 40 also may be mounted at various side rake angles. Similarly, the gouging cutting elements 50 may be mounted at various back rake angles 36, and side rake angles, or with both back rake angles 36 and side rake angles. The gouging cutting elements 50 may be mounted with a forward rake angle 36 of from about zero degrees (0°) to about ninety degrees (90°). In some embodiments, the forward rake angle 36 may be greater than approximately fifteen degrees (15°), or may be about forty-five degrees (45°). If the gouging cutting element 50 has a forward rake angle 36 (i.e., not a back rake angle or a neutral back rake angle), the gouging cutting element 50 will "lean into the formation" (i.e. the portion of the gouging cutting element 50 configured to engage formation material will lead a distal end of the gouging cutting element 50 as the drill bit 10' rotates). In addition, the gouging cutting elements 50 may be mounted with their respective longitudinal axes "tilted" to one side or another from the perpendicular (i.e., the gouging cutting elements 50 may have side rake angles). Of course, the forward rake angle 36 of gouging cutting elements 50 is offset from a forward rake angle of cutting faces 55 due to the cone angle of the cutting face 55.

Cutting elements 40, 50 may be mounted with side rake angles, such as to simplify tooling. For example, a cylindrical body of a gouging cutting element 50 may be offset from a desired path 30, yet due to the side rake angle, the cutting face 55 may still follow the desired path 30. By varying the side rake angle of cutting elements 40, 50, paths 30 of the cutting elements 40, 50 may be spaced more tightly in some areas than in other areas. In other words, near a target area (the area in which many gouging cutting elements 50 are desired), gouging cutting elements 50 may have side rake angles facing toward the target area, placing the cutting faces 55 within the target area. In embodiments in which cylindrical bodies of the gouging cutting elements 50 are configured to rotationally follow other cutting elements 40, 50, a side rake angle may allow the cutting faces 55 to follow paths 30 different from the paths 30 of the cutting elements 40, 50 being followed. For example, a path 30 of a gouging cutting element 50 having a side rake angle may be rotationally outside a path 30 of a cutting element 40, 50 which the gouging cutting element 50 is configured to rotationally follow.

In some embodiments, gouging cutting elements 50 may be configured to engage formation material at a point deeper in the formation than the shearing cutting elements 40. That is, the gouging cutting elements 50 may have an over-exposure 38 to the formation with respect to the shearing cutting elements 40. In other embodiments, the gouging cutting elements 50 and the shearing cutting elements 40 may be arranged such that there is no over-exposure 38. The over-exposure 38 (if any) may be from zero to about 2.54 mm (0.100 in). For example, the over-exposure 38 may be about 1.27 mm (0.050 in). In some embodiments, the gouging cutting elements 50 have an under-exposure to the formation with respect to the shearing cutting elements 40. The under-exposure (if any) may be from zero to about 2.54 mm (0.100 in).

Figure 3:
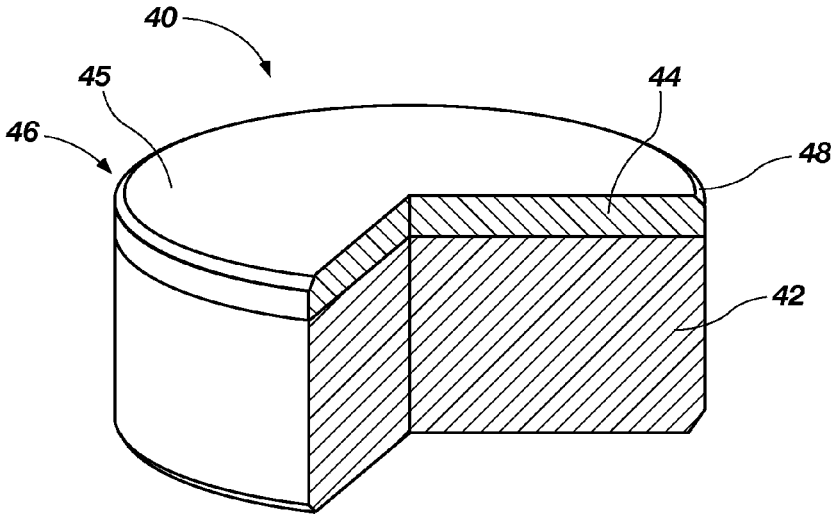
FIG. 3 is a partially cut-away perspective view of a shearing cutting element that may be used in embodiments of earth-boring tools of the present invention, such as the drill bit of FIG. 1.

FIG. 3 is a perspective view of a partially cut-away shearing cutting element 40 of the drill bits 10, 10' of FIGS. 1 and 2A through 2D. The shearing cutting element 40 includes a cutting element substrate 42 having a diamond table 44 thereon. The diamond table 44 may comprise a polycrystalline diamond (PCD) material, and may have an at least substantially planar cutting face 45 (although the interface between the diamond table 44 and the substrate 42 may be non-planar, as known in the art). Optionally, the diamond table 44 may have a chamfered edge 46. The chamfered edge 46 of the diamond table 44 shown in FIG. 3 has a single chamfer surface 48, although the chamfered edge 46 also may have additional chamfer surfaces, and such additional chamfer surfaces may be oriented at chamfer angles that differ from the chamfer angle of the chamfer surface 48, as known in the art. The cutting element substrate 42 may have a generally cylindrical shape, as shown in FIG. 3. The diamond table 44 may have an arcuate, or "radiused" edge or edge portion in lieu of, or in addition to, one or more chamfered surfaces at a peripheral edge, as known to those of ordinary skill in the art.

The diamond table 44 may be formed on the cutting element substrate 42, or the diamond table 44 and the substrate 42 may be separately formed and subsequently attached together. The cutting element substrate 42 may be formed from a material that is relatively hard and resistant to wear. For example, the cutting element substrate 42 may be formed from and include a ceramic-metal composite material (often referred to as "cermet" materials). The cutting element substrate 42 may include a cemented carbide material, such as a cemented tungsten carbide material, in which tungsten carbide particles are cemented together in a metallic matrix material. The metallic matrix material may include, for example, cobalt, nickel, iron, or alloys and mixtures thereof. In some instances, a cutting element substrate 42 may comprise two pieces, the piece immediately supporting the diamond table 44 and on which the diamond table 44 has been formed being bonded to another, longer piece of like diameter. In any case, shear cutting elements 40 are secured in pockets in blades 12 as depicted in FIG. 1, such as by brazing.

As a shearing cutting element 40 cuts formation material, the formation cuttings generally are deflected over and across the substantially planar cutting face 45 of the shearing cutting element 40 in a single direction generally away from (e.g., perpendicular to) the surface of the formation.

Figure 4:
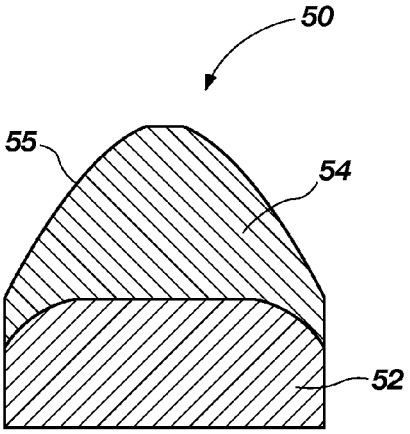
FIG. 4 illustrates a cross-sectional view of a dome-shaped gouging cutting element that may be used as a cutting element in embodiments of earth-boring tools of the present invention, such as the drill bits of FIGS. 1 and 2A through 2D.

FIG. 4 is a cross-sectional view of a gouging cutting element 50 of the drill bits 10, 10' of FIGS. 1 and 2A through 2D. The gouging cutting element 50 includes a cutting element substrate 52 having a diamond table 54 thereon. The diamond table 54 may comprise a polycrystalline diamond (PCD) material, and may have a non-planar cutting face 55. The gouging cutting element 50 of FIG. 4 has a substantially dome-like shape, which may also be characterized as a convex-frustoconical shape, with an outwardly bowing surface. In other words, the cutting face 55 of the diamond table 54 may have a substantially dome-like shape. The cutting element substrate 52 may be generally similar to the cutting element substrate 42 of FIG. 3, and may be generally cylindrical and formed from the materials previously mentioned in relation to the cutting element substrate 42. Furthermore, the diamond table 54 may be formed on the cutting element substrate 52, or the diamond table 54 and the substrate 52 may be separately formed and subsequently attached together.

As discussed previously, the gouging cutting element 50 may be a backup gouging cutting element. As a backup gouging cutting element cuts formation material substantially within a kerf cut in the formation material by a corresponding shearing cutting element 40, the formation cuttings generally are deflected over and around the non-planar cutting face 55 of the backup gouging cutting element in several directions, including to the lateral sides of the backup gouging cutting element in directions generally parallel to the surface of the formation. As used in the context of the action of backup gouging cutting elements, the term "substantially within" encompasses a gouging or crushing cutting action on the formation material at the bottom of the kerf formed by a rotationally leading shearing cutting element 40, on formation material on one or both sides of the kerf, or on formation material of both the bottom and sides of the kerf. Further, the cutting action may be upon previously uncut formation material, formation material which has been sheared from the formation, or both. Gouging cutting elements 50 may also be placed laterally between two preceding shearing cutting elements, to gouge and crush uncut formation material laterally between kerfs cut by those cutting elements.

Figure 5:
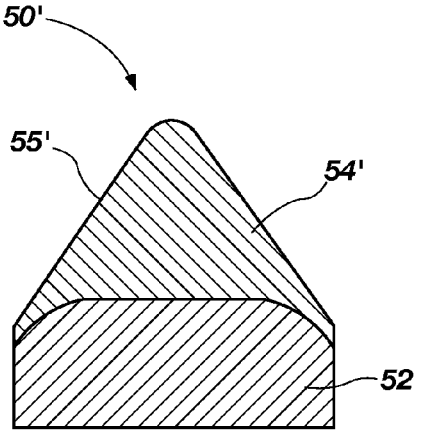
FIG. 5 illustrates a cross-sectional view of a cone-shaped gouging cutting element that may be used in embodiments of earth-boring tools of the present invention, such as the drill bits of FIGS. 1 and 2A through 2D.

FIG. 5 is a cross-sectional view of another gouging cutting element 50' that may be used on embodiments of earth-boring tools of the present disclosure, such as the drill bit 10 of FIG. 1. The gouging cutting element 50' is substantially similar to the gouging cutting element 50 of FIG. 4, but has a substantially frustoconical shape, with a rounded outer end, instead of a substantially dome-like shape. In other words, a cutting face 55' of a diamond table 54' of the gouging cutting element 50' may have a frustoconical shape. The gouging cutting element 50' may be used in place of any or all of gouging cutting elements 50 in the drill bit 10 shown in FIG. 1.

Many different types of gouging cutting elements are known in the art and may be employed as gouging cutting elements in embodiments of earth-boring tools of the present disclosure. For example, U.S. Pat. No. 5,890,552 (issued Apr. 6, 1999 and is entitled "Superabrasive-tipped Inserts for Earth-Boring Drill Bits") and U.S. Patent Application Publication No. US 2008/0035387 A1 (published Feb. 14, 2008 and is entitled "Downhole Drill Bit"), now U.S. Pat. No. 8,590,644, issued Nov. 26, 2013, the disclosures of which are incorporated herein in their entireties by this reference, disclose various configurations of gouging cutting elements that may be employed in embodiments of earth-boring tools of the present disclosure. Furthermore, two or more gouging cutting elements having different shapes may be employed on the same earth-boring tool, and may be mounted on a common blade of an earth-boring tool, in accordance with further embodiments of the disclosure. Gouging cutting elements of embodiments of the present disclosure may be designed, shaped, and otherwise configured to provide a cutting action during drilling, as opposed to merely providing a bearing function or a depth-of-cut limiting function for limiting a depth-of-cut of the shearing cutting elements.

Referring again to FIG. 1, a plurality of cutting elements is mounted to each of the blades 12. The plurality of cutting elements includes shearing cutting elements 40, as well as gouging cutting elements 50. As shown in FIG. 1, the number of gouging cutting elements 50 may be fewer than the number of shearing cutting elements 40. In configurations in which gouging cutting elements 50 are backup gouging cutting elements, not all of the shearing cutting elements 40 need have corresponding backup gouging cutting elements. Gouging cutting elements 50 may be secured in sockets, as depicted in FIG. 1, such as by brazing. Further, and as shown in FIG. 2D, cutting elements 50 may be recessed within the sockets to the same or varying depths, to provide a desired degree of exposure above the surrounding surface of a blade 12.

The shearing cutting elements 40 mounted to each blade 12 may extend along the blade 12 in a row. Each of the gouging cutting elements 50 may be mounted on a blade 12 located directly rotationally behind a shearing cutting element 40. The gouging cutting elements 50 also may be mounted in rows. In some embodiments, however, the gouging cutting elements 50 in a common row may be staggered in position relative to one another along the common row to provide sufficient space between one another to allow for positioning of the gouging cutting elements 50 at desirable positions, back rake angles, and side rake angles. In other words, gouging cutting elements 50 may be positioned rotationally in front of, or rotationally behind, one or more other adjacent gouging cutting elements 50 in the common row to provide adequate spacing therebetween.

Furthermore, although only one row of gouging cutting elements 50 is illustrated on each blade 12 in the figures, in additional embodiments of the disclosure, two, three, or more rows of gouging cutting elements 50 may be provided on one or more blades 12. In some embodiments, rows of cutting elements on one or more blades 12 may include a mixture of shearing cutting elements 40 and gouging cutting elements 50, such as, for example, rows of cutting elements as described in U.S. patent application Ser. No. 12/793,396, filed Jun. 3, 2010, now U.S. Pat. No. 8,505,634, issued Aug. 13, 2013, and entitled "Earth-Boring Tools Having Differing Cutting Elements on a Blade and Related Methods," the entire disclosure of which is incorporated herein by reference.

Figure 6A:
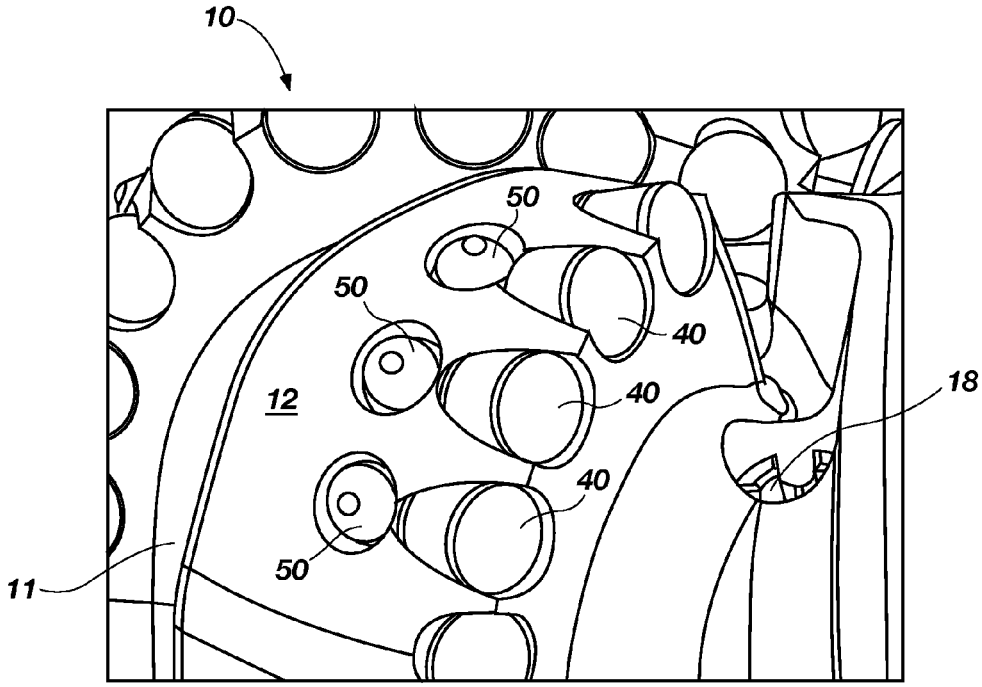
FIGS. 6A and 6B are enlarged partial views of shearing cutting elements and gouging cutting elements of the drill bit of FIG. 1.
Figure 6B:
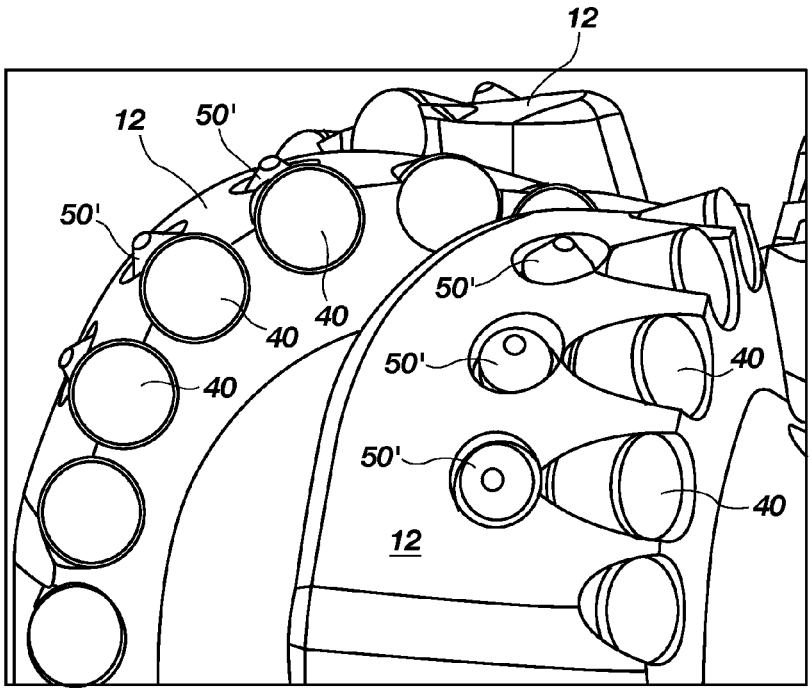

FIGS. 6A and 6B are enlarged views of two groups of gouging cutting elements 50, 50' drill bit 10 of FIG. 1 and FIGS. 4 and 5, respectively. The gouging cutting elements 50, 50' are mounted to a blade 12 of the bit body 11 at a location within a shoulder region 28 along the profile of the blade 12. In additional embodiments of the disclosure, gouging cutting elements 50, 50' may be mounted in any of a cone region 24, a nose region 26, a shoulder region 28, and a gage region of a profile of a blade 12 of a drill bit 10. For example, in some embodiments, the gouging cutting elements 50, 50' may be mounted only in a nose region 26 and a shoulder region 28, with not gouging cutting elements 50, 50' in a cone region 24. In some embodiments, the gouging cutting elements 50, 50' may be mounted only in a shoulder region 28.

Figure 7A:
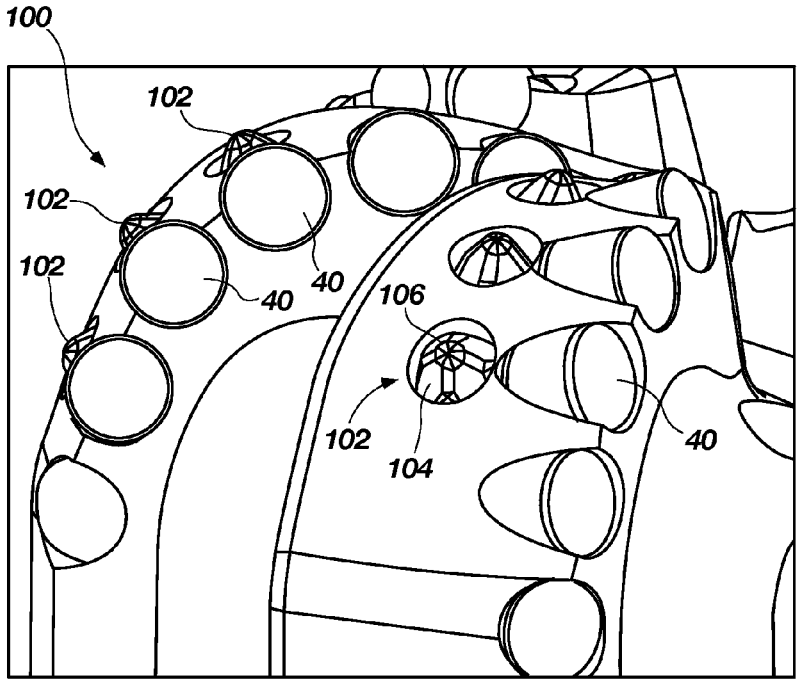
FIGS. 7A and 7B are enlarged partial views like those of FIGS. 6A and 6B illustrating different gouging cutting elements that may be used in additional embodiments of earth-boring tools of the invention.
Figure 7B:
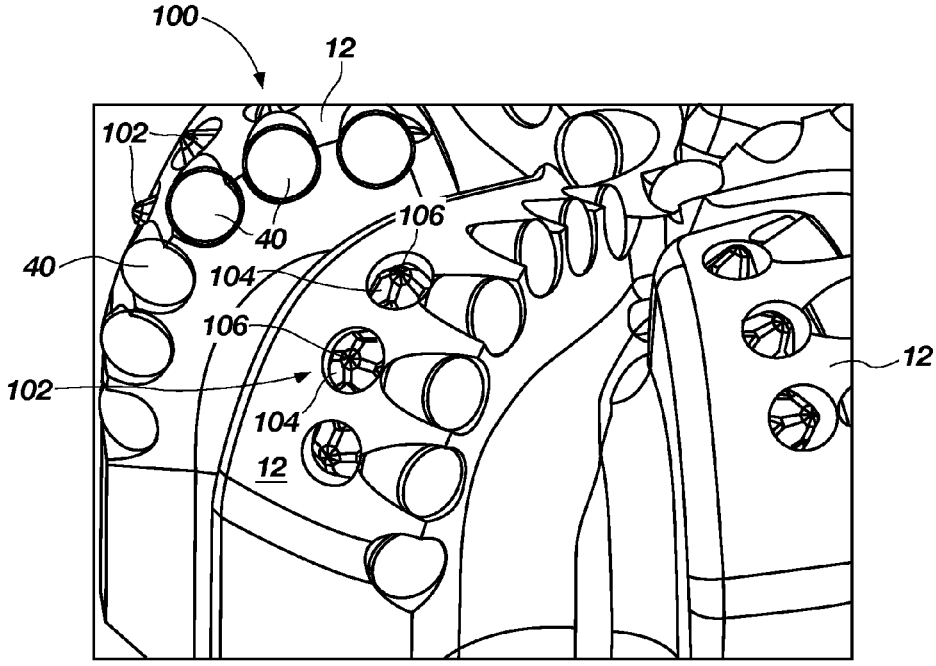

FIGS. 7A and 7B are enlarged views of another embodiment of a drill bit 100 that is substantially similar to the drill bit 10 of FIG. 1, and includes a bit body 11 and blades 12. The drill bit 100, however, includes gouging cutting elements 102 that have a pyramidal shape. The gouging cutting elements 102 have four generally planar side surfaces 104, which may also be termed "facets," that converge at a radially outward pointed apex 106. Adjacent side surfaces 104 may have smaller facets laterally therebetween, or rounded surfaces.

Figure 8A:
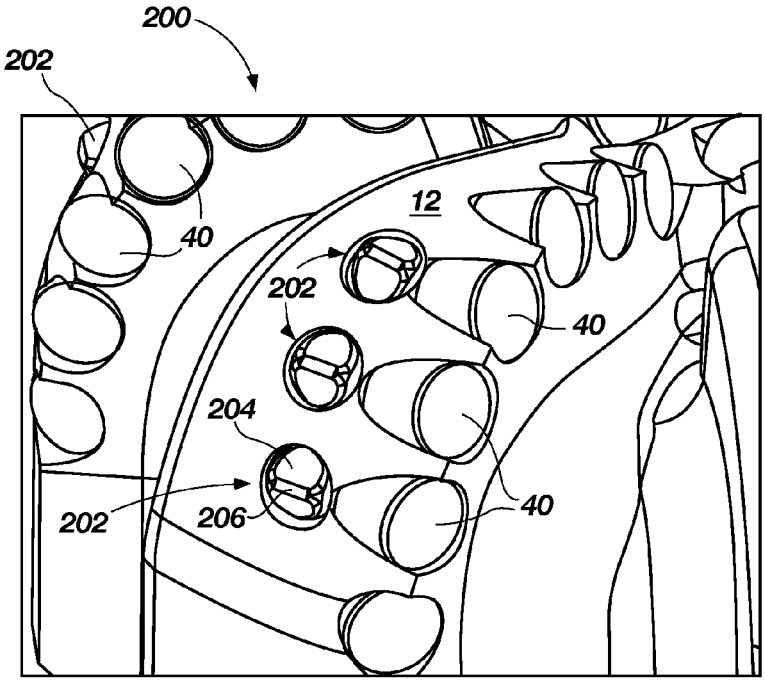
FIGS. 8A and 8B are enlarged partial views illustrating additional, different gouging cutting elements that may be used in further embodiments of earth-boring tools of the invention.
Figure 8B:
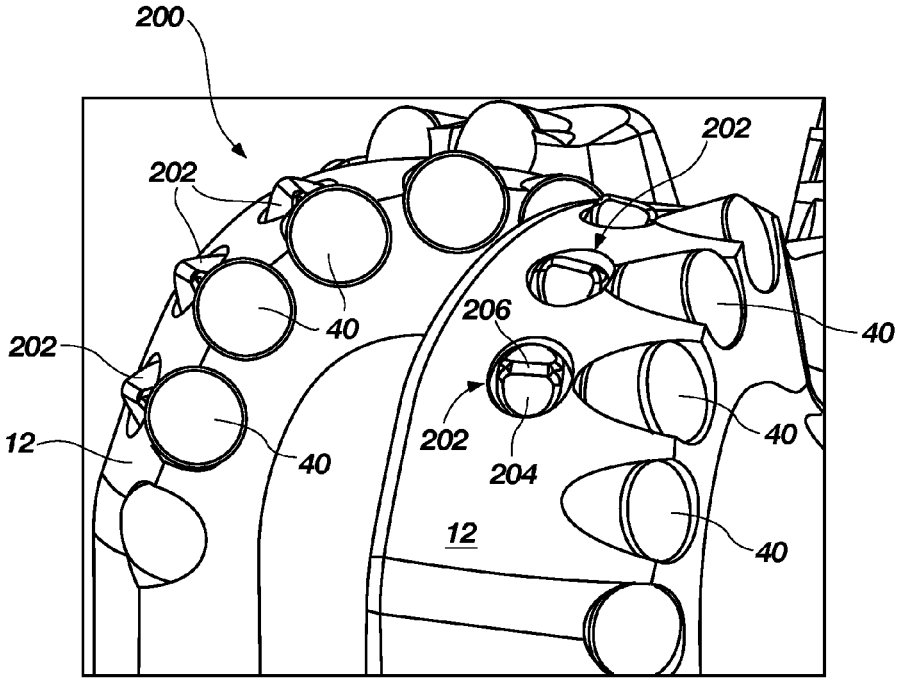

FIGS. 8A and 8B are enlarged views of another embodiment of a drill bit 200 that is substantially similar to the drill bit 10 of FIG. 1, and includes a bit body 11 and blades 12. The drill bit 200, however, includes gouging cutting elements 202 that have a chisel shape. The gouging cutting elements 202 have side surfaces 204 that converge at a radially outward linear apex 206. The gouging cutting elements 202 may be oriented on the blade 12 such that the linear apexes 206 are oriented generally parallel to the direction of bit rotation, as shown in FIGS. 8A and 8B, such that the linear apexes 206 are oriented generally perpendicular to the direction of bit rotation, or such that the linear apexes 206 are oriented at an acute angle to the direction of bit rotation.

Figure 9:
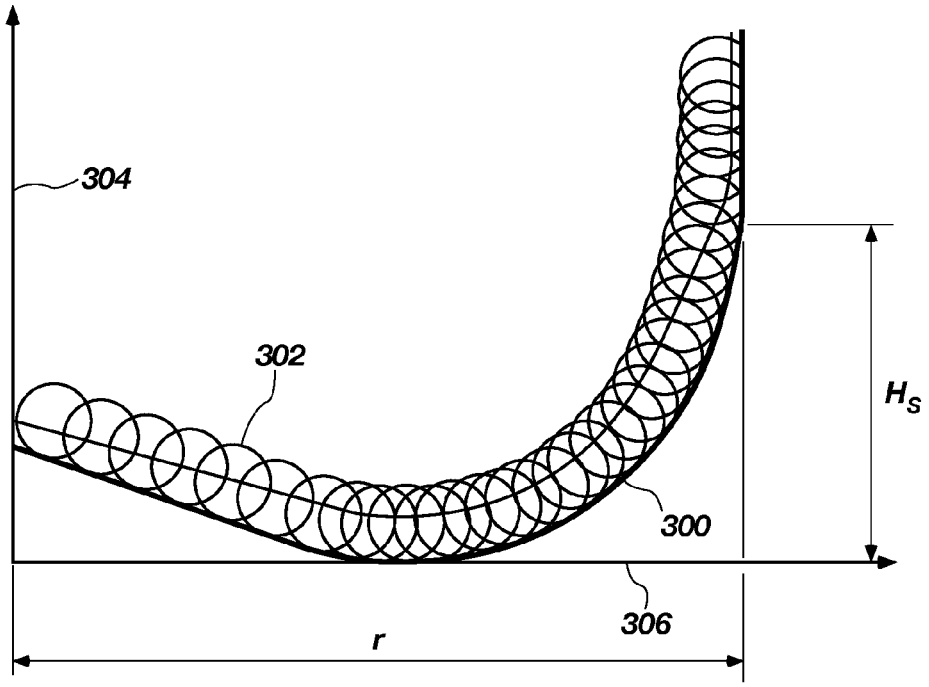
FIG. 9 is a cutting element layout drawing of a drill bit of some embodiments of the invention.

FIG. 9 shows a schematic partial side cross-sectional view of a drill bit (such as drill bit 10, shown in FIG. 1), as if all cutting elements 302 (for example, shearing cutting elements 40 and gouging cutting elements 50) disposed thereon were rotated onto a single blade protruding from a bit body, extending from a centerline of the bit body to the gage. Such a view is commonly termed a "cutter layout" drawing or "cutting element layout" drawing and may be used to design rotary drill bits, as known in the art. More particularly, each of the cutting elements 302 is shown in relation to vertical axis 304 and horizontal axis 306. The vertical axis 304 represents an axis, conventionally the centerline of the bit, about which the drill bit rotates. The distance from each cutting element 302 to the vertical axis 304 corresponds to the radial position of each cutting element on the drill bit. The distance from each cutting element 302 to the horizontal axis 306 corresponds to the longitudinal position of each cutting element on the drill bit. Cutting elements 302 may be positioned along a selected profile 300, as known in the art. As shown in FIG. 9, radially adjacent cutting elements 302 may overlap one another. Furthermore, two or more cutting elements 302 of a drill bit may be positioned at substantially the same radial and longitudinal position.

The cutting elements farthest from the vertical axis 304 define a bit diameter (2r, where r, shown in FIG. 9, is the radius) at a vertical position higher than shoulder height $H_S$ (also referred to in the art as bit face height or profile height). The bit profile may be characterized by the ratio of $H_S/2r$. Bits for which $H_S/2r$ is less than about 0.10 may be referred to as having "flat" profiles, whereas bits for which $H_S/2r$ is greater than about 0.25 may be referred to as having "curved" profiles. Gouging cutting elements 50 (FIG. 1) may have a larger effect on drilling efficiency in drill bits with flat profiles than on drilling efficiency in drill bits with curved profiles. However, a person having ordinary skill in the art will recognize that profiles 300 may have various curvatures at different coordinates along the profile 300. In other words, the "flat" and "curved" nomenclature are generalizations that may not account for all the features of bit profile. Nevertheless, the ratio $H_S/2r$ may be useful for determining whether existing drill bits are likely to exhibit improved efficiency through the use of embodiments of the present disclosure. In some embodiments of the present disclosure, drill bits may have a bit profile of from about 0.25 to about 0.75 (i.e., may have a curved profile). In other embodiments, drill bits may have a bit profile of from about 0.02 to about 0.10 (i.e., may have a flat profile). In yet other embodiments, drill bits may have a bit profile of from about 0.10 to about 0.25.

In each of the embodiments described herein, the gouging cutting elements may have or exhibit an exposure equal to or different from an exposure of corresponding shearing cutting elements. As used herein, the term "exposure" has the same ordinary meaning used in the art, and means the maximum distance that the cutting element extends outwardly from the immediately surrounding surface of the blade (or another surface) on which the cutting element is mounted. For example, in some embodiments, the gouging cutting elements may have an exposure greater than an exposure of the corresponding shearing cutting elements (i.e., the gouging cutting elements may have an over-exposure with respect to corresponding shearing cutting elements). In additional embodiments, the gouging cutting elements may have an exposure less than an exposure of the corresponding shearing cutting elements (i.e., the gouging cutting elements may have an under-exposure with respect to corresponding shearing cutting elements). In yet further embodiments, the gouging cutting elements may have an exposure substantially equal to an exposure of the corresponding shearing cutting elements.

Earth-boring tools that include shearing cutting elements and gouging cutting elements may benefit from the different cutting actions of both the shearing cutting elements and the gouging cutting elements. Embodiments of earth-boring tools of the present disclosure, such as the drill bit 10 of FIG. 1, may exhibit improved drilling efficiency during drilling by allowing cuttings to flow easily around the gouging cutting elements. Additionally, the gouging and crushing cutting action of the gouging cutting elements may complement the shearing cutting action of the shearing cutting elements, and the combination of cutting mechanisms may result in a synergistic effect that may result in improved drilling efficiency and improved tool stability.

Additional non-limiting example embodiments of the disclosure are described below.

Embodiment 1

An earth-boring tool, comprising a body, at least one blade projecting outwardly from the body, and a plurality of cutting elements carried by the at least one blade. The plurality of cutting elements comprises at least one shearing cutting element comprising an at least substantially planar cutting face positioned and oriented for shearing a subterranean formation when the earth-boring tool is rotated under applied force against the subterranean formation; and at least one gouging cutting element located rotationally behind the at least one shearing cutting element on the at least one blade. The at least one gouging cutting element comprises a cutting face positioned and oriented for at least one of crushing and gouging the subterranean formation when the earth-boring tool is rotated under applied force.

Embodiment 2

The earth-boring tool of embodiment 1, wherein the at least one shearing cutting element comprises a polycrystalline diamond material, and wherein the at least substantially planar cutting face of the at least one shearing cutting element comprises a surface of the polycrystalline diamond material.

Embodiment 3

The earth-boring tool of embodiment 1 or embodiment 2, wherein the at least one gouging cutting element comprises a polycrystalline diamond material, and wherein the cutting face of the at least one gouging cutting element comprises a surface of the polycrystalline diamond material.

Embodiment 4

The earth-boring tool of any of embodiments 1 through 3, wherein the cutting face of the at least one gouging cutting element is non-planar.

Embodiment 5

The earth-boring tool of any of embodiments 1 through 4, wherein the cutting face of the at least one gouging cutting element is substantially dome-like in shape.

Embodiment 6

The earth-boring tool of any of embodiments 1 through 4, wherein the cutting face of the at least one gouging cutting element is substantially frustoconically shaped.

Embodiment 7

The earth-boring tool of any of embodiments 1 through 6, wherein the earth-boring tool comprises a fixed-cutter earth-boring rotary drill bit, and wherein each of the at least one shearing cutting element and the at least one gouging cutting element is located in a shoulder region, a nose region, or a cone region of the fixed-cutter earth-boring rotary drill bit.

Embodiment 8

The earth-boring tool of any of embodiments 1 through 7, wherein the at least one gouging cutting element is located in a shoulder region or a nose region of the fixed-cutter earth-boring rotary drill bit.

Embodiment 9

The earth-boring tool of any of embodiments 1 through 8, wherein the at least one gouging cutting element is positioned to follow a path of the at least one shearing cutting element when the earth-boring tool is rotated under applied force.

Embodiment 10

The earth-boring tool of any of embodiments 1 through 9, wherein the at least one blade comprises a plurality of blades, each blade of the plurality of blades projecting outwardly from the body and carrying a row of cutting elements, each row of cutting elements comprising shearing cutting elements, each of the shearing cutting elements comprising a polycrystalline diamond material having an at least substantially planar cutting face positioned and oriented for shearing a subterranean formation when the earth-boring tool is rotated under applied force, and wherein each of at least two blades of the plurality of blades comprises at least two gouging cutting elements comprising a polycrystalline diamond material having a cutting face positioned and oriented for at least one of crushing and gouging a subterranean formation when the earth-boring tool is rotated under applied force.

Embodiment 11

The earth-boring tool of any of embodiments 1 through 10, wherein the cutting face of each shearing cutting element is at least substantially planar and the cutting face of each gouging cutting element is substantially dome-like in shape or substantially frustoconical in shape.

Embodiment 12

The earth-boring tool of any of embodiments 1 through 11, wherein a shortest distance between a longitudinal axis of the earth-boring tool and a cutting surface of the at least one gouging cutting element is substantially equal to a shortest distance between the longitudinal axis of the earth-boring tool and a cutting surface of the at least one shearing cutting element.

Embodiment 13

The earth-boring tool of any of embodiments 1 through 12, wherein the at least one gouging cutting element exhibits an exposure equal to an exposure of the at least one shearing cutting element.

Embodiment 14

The earth-boring tool of any of embodiments 1 through 12, wherein the at least one gouging cutting element exhibits an exposure greater than an exposure of the at least one shearing cutting element.

Embodiment 15

The earth-boring tool of any of embodiments 1 through 12, wherein the exposure of the at least one gouging cutting element is less than about 2.54 mm (0.100 in) greater than an exposure of the at least one shearing cutting element.

Embodiment 16

The earth-boring tool of any of embodiments 1 through 15, wherein a ratio of a shoulder height of the body to a diameter of the body is about 0.10 or less.

Embodiment 17

The earth-boring tool of any of embodiments 1 through 16, wherein the at least one blade comprises at least one primary blade, and wherein the at least one gouging cutting element is disposed on the at least one primary blade.

Embodiment 18

A method of forming an earth-boring tool, comprising mounting a shearing cutting element comprising an at least substantially planar cutting face to a body of an earth-boring tool; locating and orienting the shearing cutting element on the body of the earth-boring tool for shearing a subterranean formation when the earth-boring tool is used to form or enlarge a wellbore; mounting a backup gouging cutting element comprising a non planar cutting face to the body of the earth-boring tool; locating and orienting the backup gouging cutting element on the body of the earth-boring tool for at least one of crushing and gouging a subterranean formation when the earth-boring tool is used to form or enlarge a wellbore; and positioning the backup gouging cutting element on the body of the earth-boring tool such that the backup gouging cutting element will gouge formation material within a kerf cut in the formation material by the shearing cutting element.

Embodiment 19

The method of embodiment 18, wherein positioning the backup gouging cutting element on the body of the earth-boring tool comprises positioning the backup gouging cutting element on the body of the earth-boring tool such that a shortest distance between a longitudinal axis of the earth-boring tool and the at least one backup gouging cutting element is substantially equal to a shortest distance between the longitudinal axis of the earth-boring tool and the at least one shearing cutting element.

Embodiment 20

The method of embodiment 18 or embodiment 19, further comprising selecting the body of the earth-boring tool to comprise a bit body of a fixed-cutter earth-boring rotary drill bit comprising a plurality of blades, and mounting each of the shearing cutting element and the backup gouging cutting element on a blade of the plurality of blades.

Embodiment 21

The method of any of embodiments 18 through 20, further comprising mounting each of the shearing cutting element and the backup gouging cutting element on a common blade of the plurality of blades.

Embodiment 22

The method of any of embodiments 18 through 21, further comprising selecting the shearing cutting element to comprise a polycrystalline diamond material having a surface comprising the at least substantially planar cutting face.

Embodiment 23

The method of any of embodiments 18 through 22, further comprising selecting the backup gouging cutting element to comprise a polycrystalline diamond material having a surface comprising the non planar cutting face.

Embodiment 24

The method of any of embodiments 18 through 23, further comprising mounting the backup gouging cutting element on the body of the earth-boring tool to have an exposure greater than an exposure of the shearing cutting element.

Embodiment 25

The method of any of embodiments 18 through 23, further comprising mounting the backup gouging cutting element on the body of the earth-boring tool to have an exposure less than an exposure of the shearing cutting element.

Embodiment 26

A method of forming an earth-boring tool, comprising mounting a plurality of shearing cutting elements, each comprising an at least substantially planar cutting face to a body of an earth-boring tool; locating and orienting each shearing cutting element of the plurality on the body of the earth-boring tool for shearing a subterranean formation when the earth-boring tool is used to form or enlarge a wellbore; mounting a backup gouging cutting element comprising a non-planar cutting face to the body of the earth-boring tool; and positioning the backup gouging cutting element on the body of the earth-boring tool such that the backup gouging cutting element will gouge formation material between a plurality of kerfs cut in the formation material by the plurality of shearing cutting elements.

Although the foregoing description contains many specifics, these are not to be construed as limiting the scope of the present invention, but merely as providing certain exemplary embodiments. Similarly, other embodiments of the invention may be devised that do not depart from the scope of the present invention. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. An earth-boring tool, comprising:

a body;

at least one blade projecting outwardly from the body; and a plurality of cutting elements carried by the at least one blade, the plurality of cutting elements comprising:

at least one shearing cutting element comprising an at least substantially planar cutting face positioned and oriented for shearing a surface of a subterranean formation when the earth-boring tool is rotated under applied force against the subterranean formation; and at least one gouging cutting element located rotationally behind the at least one shearing cutting element on the at least one blade, the at least one gouging cutting element having a longitudinal central axis angled with respect to a plane perpendicular to the surface of the subterranean formation such that the at least one gouging element has a forward rake angle greater than approximately fifteen degrees, the at least one gouging cutting element comprising a non-planar cutting face positioned and oriented for at least one of crushing and gouging the surface of the subterranean formation when the earth-boring tool is rotated under the applied force.

2. The earth-boring tool of claim 1, wherein the at least one shearing cutting element comprises a polycrystalline diamond material, and wherein the at least substantially planar cutting face of the at least one shearing cutting element comprises a surface of the polycrystalline diamond material.

3. The earth-boring tool of claim 1, wherein the at least one gouging cutting element comprises a polycrystalline diamond material, and wherein the cutting face of the at least one gouging cutting element comprises a surface of the polycrystalline diamond material.

4. The earth-boring tool of claim 1, wherein the non-planar cutting face of the at least one gouging cutting element is substantially dome-like in shape.

5. The earth-boring tool of claim 1, wherein the non-planar cutting face of the at least one gouging cutting element is substantially frustoconically shaped.

6. The earth-boring tool of claim 1, wherein the earth-boring tool comprises a fixed-cutter earth-boring rotary drill bit, and wherein each of the at least one shearing cutting element and the at least one gouging cutting element is located in a shoulder region, a nose region, or a cone region of the fixed-cutter earth-boring rotary drill bit.

7. The earth-boring tool of claim 6, wherein the at least one gouging cutting element is located in a shoulder region or a nose region of the fixed-cutter earth-boring rotary drill bit.

8. The earth-boring tool of claim 1, wherein the at least one gouging cutting element is positioned to follow a path of the at least one shearing cutting element when the earth-boring tool is rotated under applied force.

9. The earth-boring tool of claim 1, wherein the at least one blade comprises a plurality of blades, wherein the at least one shearing element comprises a plurality of shearing elements on each of the plurality of blades, and wherein the at least one gouging element comprises at least two gouging elements on each of at least two blades of the plurality of blades.

10. The earth-boring tool of claim 9, wherein the cutting face of each of the at least two gouging cutting elements is substantially dome-like in shape or substantially frustoconical in shape.

11. The earth-boring tool of claim 1, wherein a shortest distance between a longitudinal axis of the earth-boring tool and a cutting surface of the at least one gouging cutting element is substantially equal to a shortest distance between the longitudinal axis of the earth-boring tool and a cutting surface of the at least one shearing cutting element.

12. The earth-boring tool of claim 11, wherein the at least one gouging cutting element exhibits an exposure equal to an exposure of the at least one shearing cutting element.

13. The earth-boring tool of claim 11, wherein the exposure of the at least one gouging cutting element is less than about 2.54 mm (0.100 in.) greater than an exposure of the at least one shearing cutting element.

14. The earth-boring tool of claim 1, wherein a ratio of a shoulder height of the body to a diameter of the body is about 0.10 or less.

15. The earth-boring tool of claim 1, wherein the at least one blade comprises at least one primary blade, and wherein the at least one gouging cutting element is disposed on the at least one primary blade.

16. The earth-boring tool of claim 1, wherein the at least one shearing cutting element and the at least one gouging cutting element are located on different blades of the body than one another.

17. The earth-boring tool of claim 1, wherein the at least one gouging cutting element has a forward rake angle of about forty-five degrees.

18. The earth-boring tool of claim 1, wherein a cylindrical body of the at least one gouging cutting element is positioned to follow a path of the at least one shearing cutting element when the earth-boring tool is rotated under applied force and the non-planar cutting face of the at least one gouging cutting element is positioned to follow a different path than the cylindrical body.

19. A method of forming an earth-boring tool, comprising:

mounting a shearing cutting element comprising an at least substantially planar cutting face to a blade projecting outwardly from a body of an earth-boring tool such that the at least substantially planar cutting face is positioned and oriented for shearing a surface of a subterranean formation when the earth-boring tool is rotated under applied force against the subterranean formation; and mounting a backup gouging cutting element comprising a non-planar cutting face rotationally behind the shearing cutting element on the blade such that the backup gouging cutting element has a longitudinal central axis angled with respect to a plane perpendicular to the surface of the subterranean formation such that the at least one gouging element has a forward rake angle greater than approximately fifteen degrees, and such that the non-planar cutting face is positioned and oriented for at least one of crushing and gouging the surface of the subterranean formation when the earth-boring tool is rotated under the applied force.

20. The method of claim 19, wherein mounting the backup gouging cutting element on the blade comprises positioning the backup gouging cutting element on the blade such that a shortest distance between a longitudinal axis of the earth-boring tool and the backup gouging cutting element is substantially equal to a shortest distance between the longitudinal axis of the earth-boring tool and the shearing cutting element.

21. The method of claim 19, further comprising selecting the body of the earth-boring tool to comprise a bit body of a fixed-cutter earth-boring rotary drill bit comprising a plurality of blades.

22. The method of claim 19, further comprising selecting the shearing cutting element to comprise a polycrystalline diamond material having a surface comprising the at least substantially planar cutting face.

23. The method of claim 22, further comprising selecting the backup gouging cutting element to comprise a polycrystalline diamond material having a surface comprising the non-planar cutting face.

24. The method of claim 19, further comprising mounting the backup gouging cutting element on the blade to have an exposure greater than an exposure of the shearing cutting element.

25. The method of claim 19, further comprising mounting the backup gouging cutting element on the blade to have an exposure less than an exposure of the shearing cutting element.

26. A method of forming an earth-boring tool, comprising:

mounting a plurality of shearing cutting elements, each comprising an at least substantially planar cutting face to at least one blade projecting outwardly from a body of an earth-boring tool such that the at least substantially planar cutting face of each of the plurality of shearing cutting elements is positioned and oriented for shearing a surface of a subterranean formation when the earth-boring tool is rotated under applied force against the subterranean formation; and mounting at least one gouging cutting element comprising a non-planar cutting face rotationally behind at least one of the plurality of shearing cutting elements on the at least one blade such that the at least one gouging cutting element has a longitudinal central axis angled with respect to a plane perpendicular to the surface of the subterranean formation such that the at least one gouging element has a forward rake angle greater than approximately fifteen degrees, and such that the non-planar cutting face is positioned and oriented for at least one of crushing and gouging the surface of the subterranean formation when the earth-boring tool is rotated under the applied force.

* * * * *

UNITED STATES PATENT AND TRADEMARK OFFICE

CERTIFICATE OF CORRECTION

PATENT NO. : 8,794,356 B2
APPLICATION NO. : 13/022288
DATED : August 5, 2014
INVENTOR(S) : Nicholas J. Lyons et al.

It is certified that error appears in the above-identified patent and that said Letters Patent is hereby corrected as shown below:

On the title page:

In ITEM *Primary Examiner* change "Yong-suk" to --Yong-Suk--

Signed and Sealed this
Twentieth Day of October, 2015

Michelle K. Lee

Michelle K. Lee
*Director of the United States Patent and Trademark Office*